US006364554B2

(12) United States Patent
Huang et al.

(10) Patent No.: US 6,364,554 B2
(45) **Date of Patent: *Apr. 2, 2002**

(54) APPARATUS FOR FEEDING MEDIA IN A PRINTER

(75) Inventors: Pui Wen Huang; Kong Hock Lim; Sathiyamoorthy T. Sivanandam, all of Singapore (SG)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/474,921

(22) Filed: Dec. 29, 1999

(51) Int. Cl.[7] ..... B41J 13/02
(52) U.S. Cl. ..... 400/641; 400/636.3
(58) Field of Search ..... 400/641, 642, 400/639, 636, 636.3, 649.4, 645

(56) References Cited

U.S. PATENT DOCUMENTS

| | | | | | |
|---|---|---|---|---|---|
| 4,417,517 | A | * | 11/1983 | Matsuda et al. | 101/288 |
| 4,561,792 | A | * | 12/1985 | Behrens et al. | 400/618 |
| 5,356,229 | A | | 10/1994 | Hickman et al. | |
| 5,560,293 | A | * | 10/1996 | Boreali et al. | 101/288 |
| 5,897,259 | A | * | 4/1999 | Ahn | 400/629 |
| 5,988,907 | A | * | 11/1999 | Iso | 400/637 |
| 5,993,094 | A | * | 11/1999 | Lee | 400/625 |
| 6,076,336 | A | * | 6/2000 | Cross | 53/452 |
| 6,099,179 | A | * | 8/2000 | Higashi et al. | 400/613 |
| 6,152,442 | A | * | 11/2000 | Nishinohara et al. | 271/121 |

* cited by examiner

*Primary Examiner*—John S. Hilten
*Assistant Examiner*—Davis N. Cone

(57) ABSTRACT

A print feed mechanism for feeding print media to a printing zone of a printer in which the feed mechanism is adjustable to vary the position of a pinch roller against a drive roller so as to vary the angle at which print media is fed to the printing zone.

2 Claims, 7 Drawing Sheets

APPARATUS FOR FEEDING MEDIA IN A PRINTER

FIELD OF INVENTION

This invention relates to a print feed mechanism for use in a printer. In particular, the invention relates to an apparatus for feeding print media in a controlled manner to a printing zone of a printer.

BACKGROUND

An ink-jet printer, or any printer using wet ink, typically includes a pen, also called a printhead, a print zone located adjacent the printhead, a feed mechanism for feeding print media through the print zone, and a platen positioned adjacent the print zone. The platen has a generally flat surface which guides and supports the print medium in the print zone. During printing, ink is placed on the print medium by dropping or ejecting the ink from ink nozzles in the printhead. These features of an wet ink printer are described, for example, in U.S. Pat. No. 5,356,229, assigned to Hewlett-Packard Company, and entitled 'Print Medium Handling System To Control Pen-to-Print Medium Spacing During Printing'.

FIGS. 1 and 2 illustrate the functional elements of a printing mechanism of a known printer, for example the model HP 2500 printer available from Hewlett-Packard Company, USA. The printing mechanism includes a platen 110 with a flat print medium contacting surface 115, and a feed mechanism 140 positioned adjacent the platen. The flat expanse of the platen 110 is positioned below a printhead 120 such that the platen 110 supports the print medium 130 throughout a print zone defined between the printhead 120 and the platen 110. The print medium 130 is moved through the print zone in the direction indicated by the arrow A in FIGS. 1 and 2. At the same time, the printhead 120 performs a series of swath-like printing scans across the width of the print medium, in a direction perpendicular to the media motion direction, as indicated by arrow B in FIG. 2.

The feed mechanism 140 is ideally arranged so as to feed the print medium 130 at a downward angle onto the platen 110 such that the print medium presents a flat profile to the scanning printhead 120. Ink nozzles or pens 125 contained in the printhead are thus positioned at a uniform distance from the print medium. This constant pen-to-print medium spacing ensures optimum print quality in the printer.

In the HP 2500 printer, the feed mechanism 140 comprises four drive rollers 150 which are supported on a common axle 155, and four complementary print media guides 160. The common axle 155 is in turn supported by a chassis of the printer and is coupled via a gear mechanism to a drive motor. Each print media guide 160 includes a freely rotating pinch roller 165 which is biased against a respective drive roller 150, and a deflector plate 170 which helps to deflect the print media 130 downwards. The pinch rollers 165 operate to ensure that the print medium remains in contact with and is properly fed by the drive roller 150. The pinch rollers 165 are biased against the drive rollers at a point circumferentially displaced from the apex of the drive rollers. This displacement is indicated in FIG. 1 as an angular displacement $\alpha$, and results in the print media 130 being directed downwards in co-operation with the downward deflection produced by the deflector plate 170. The combination of the pinch roller 165 and the deflector plate 170 ensures that the print medium is fed at an appropriate dive angle to the platen 110.

FIGS. 3 and 4 are detailed sectional views showing one of the drive rollers 150 and one of the print media guides 160 of the printer feed mechanism 140, together with a support frame 310 also forming part of the printer feed mechanism. The support frame 310 is secured to a chassis of the printer and supports all four of the print media guides 160. The support frame 310 includes two slot guides 315 (one of which is not shown in FIGS. 3 and 4) which are designed to receive respective end portions of a rod 175 of the print media guide 160. The slot guides 315 prevent movement of the print media guide 160, and hence the pinch roller 165 and deflector plate 170, in the print media motion direction (arrow A in FIGS. 1 and 2). When the rod 175 is received in the slot guides 315, a raised portion 180 of the print media guide 160 abuts the lower surface of the support frame. A torsion spring which is coupled between the rod and the support frame biases the rear section of the print media guide towards the support frame as indicated by arrow C in FIG. 4. In this arrangement, the print media guide pivots about the abutting point between the raised portion 180 and the lower surface of the support frame and biases the pinch roller in contact with the surface of the drive roller 150.

It is important that the printer feed mechanism 140 is configured correctly, in order that the print medium 130 is directed at an appropriate angle onto the platen 110,. The applicant has found that during production of the HP 2500 printer, the relative positions of the print media guides 160 and the drive rollers 150 can vary, resulting in the print medium 130 being directed at inappropriate angles onto the platen 110. These inappropriate angles lead to variations in the pen-to-print medium spacing which degrades the printing quality of the printer output.

The variation of the relative positions of the print media guides 160 and the drive rollers 150 is caused by tolerances in the printer structure. These tolerances can combine to produce larger errors in the positions of the printer elements. For example, there are positional errors associated with the coupling of the print medium guide 160 to the support frame 310, the attachment of the metal frame to the printer chassis, the supporting of the drive axle 155 by the printer chassis, as well as stress-associated positional errors in the individual printer elements. These errors or variations are accentuated in wide-format printers such as the HP 2500 printer that are capable of printing onto A3 size paper.

The problem of variations in the relative positions of the print media guides 160 and the drive rollers 150 has been resolved by the applicant by producing a series of print medium guides. These series of print medium guides can be systematically and selectively attached to the support frame 310 during production until an appropriate dive angle is produced. The series of print medium guides are graded according to the protrusion distance of the deflector plate 170. Thus, each print medium guide in the series has a slightly different deflection property when coupled to the printer feed mechanism. However, this solution to the problem of variations has its drawbacks. Firstly, the solution requires there to be overproduction of the print medium guides to ensure there are sufficient quantities to form the series. Secondly, for a particular printer there may not be any one print medium guide from the series which is suitable. Thirdly, the process of systematically attaching the print medium guides and then testing the performance of the printer slows the overall production process.

In an alternative print mechanism used in the HP 2000 model printer, the platen can be raised or lowered relative to the print feed mechanism, to a position in which the print medium presents a flat profile to the scanning printhead. This print mechanism is more suited to narrow-format printers that are designed for printing onto A4 size paper.

The print mechanism is difficult to implement in wide-format printers in which the platen is correspondingly wider and requires more support.

SUMMARY OF THE INVENTION

The present invention provides for a print mechanism in which the print guide is adjustable relative to the drive roller so that the direction at which the print media is fed onto a platen can be varied to optimize printing quality in the printer.

According to the present invention there is provided a print feed mechanism for feeding print media in a controlled manner to a printing zone of a printer, the mechanism comprising a drive roller located adjacent the printing zone, and a pinch roller positioned against the drive roller, the drive roller and pinch roller acting in co-operation to feed the print media at an angle to the printing zone, wherein the feed mechanism is adjustable to vary the position of the pinch roller against the drive roller so as to vary the angle at which print media is fed to the printing zone.

A print feed mechanism in accordance with the invention has the advantage that it enables print media to be directed at an appropriate angle towards the print zone. Ideally, the adjustment is continuously variable so that the dive angle of the print media can be fully optimised.

DETAILED DESCRIPTION OF THE PREFERRED EMBODIMENTS

Figure 1:
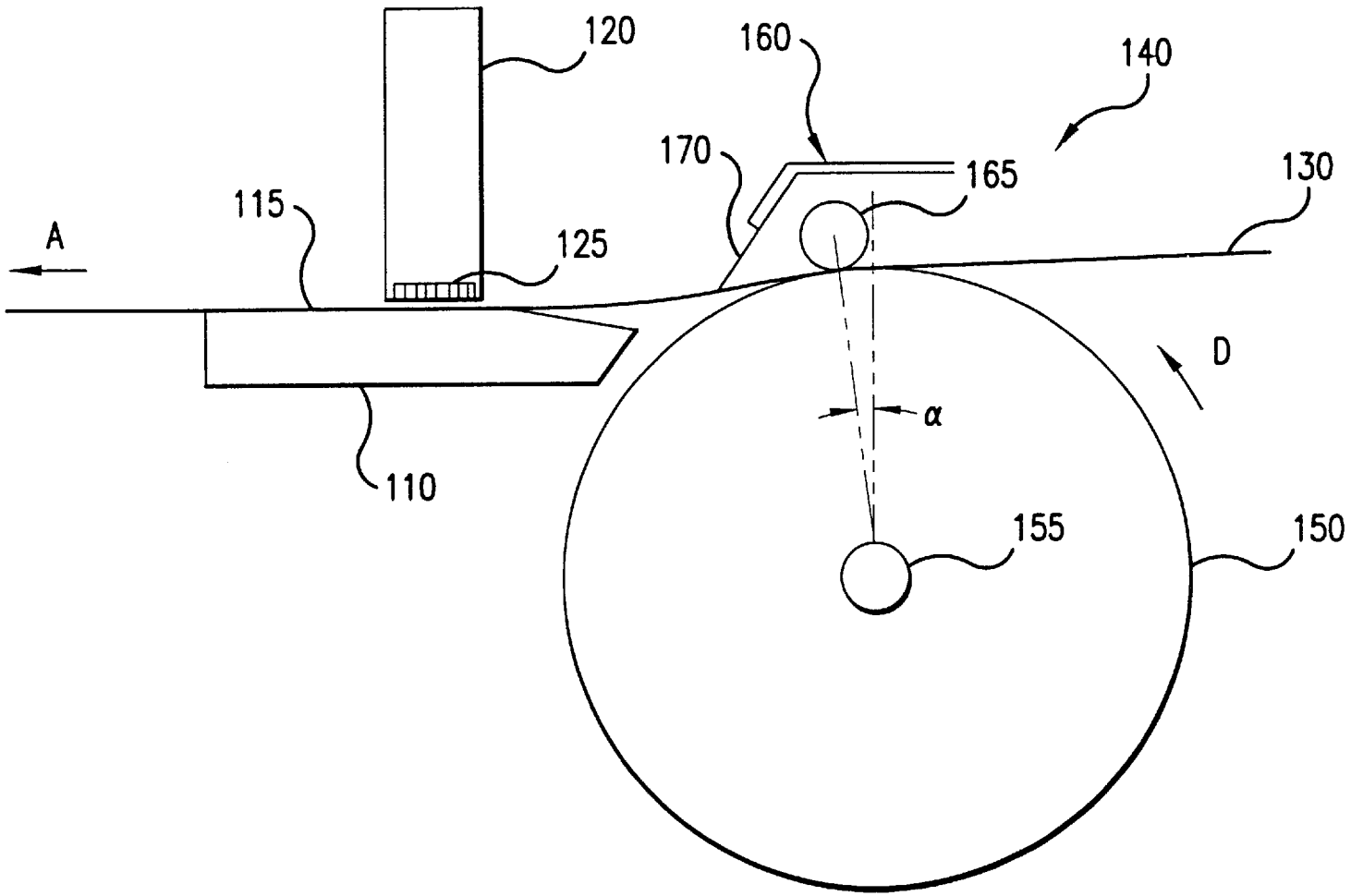
FIGS. 1 is a side view showing the functional elements of a printing mechanism of a known printer.
Figure 8:
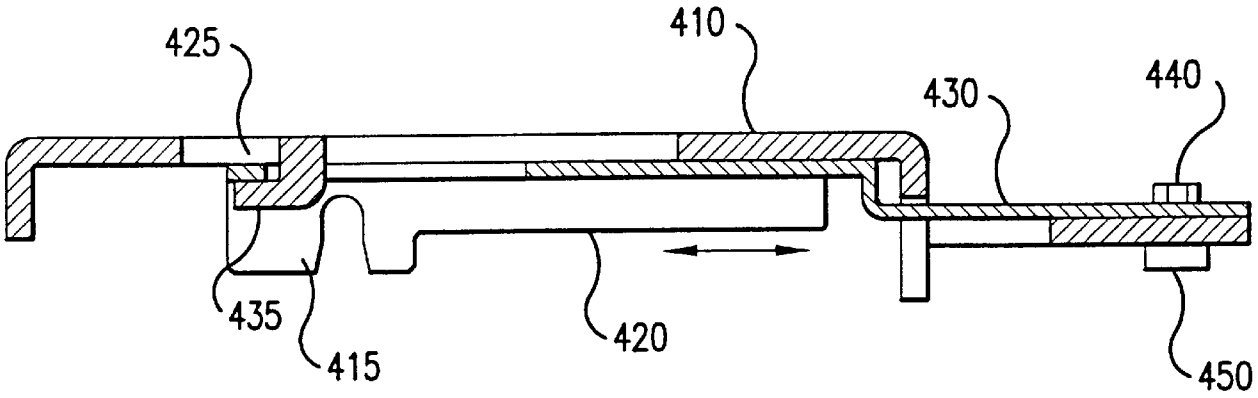
FIG. 8 is a side sectional view of the modified support frame of FIG. 7.

In the following description and the corresponding Figures, some of the elements of the printer mechanism are equivalent to the elements described in the background. Accordingly, these elements have been given the same reference numerals as their equivalent elements in the background.

Figure 2:
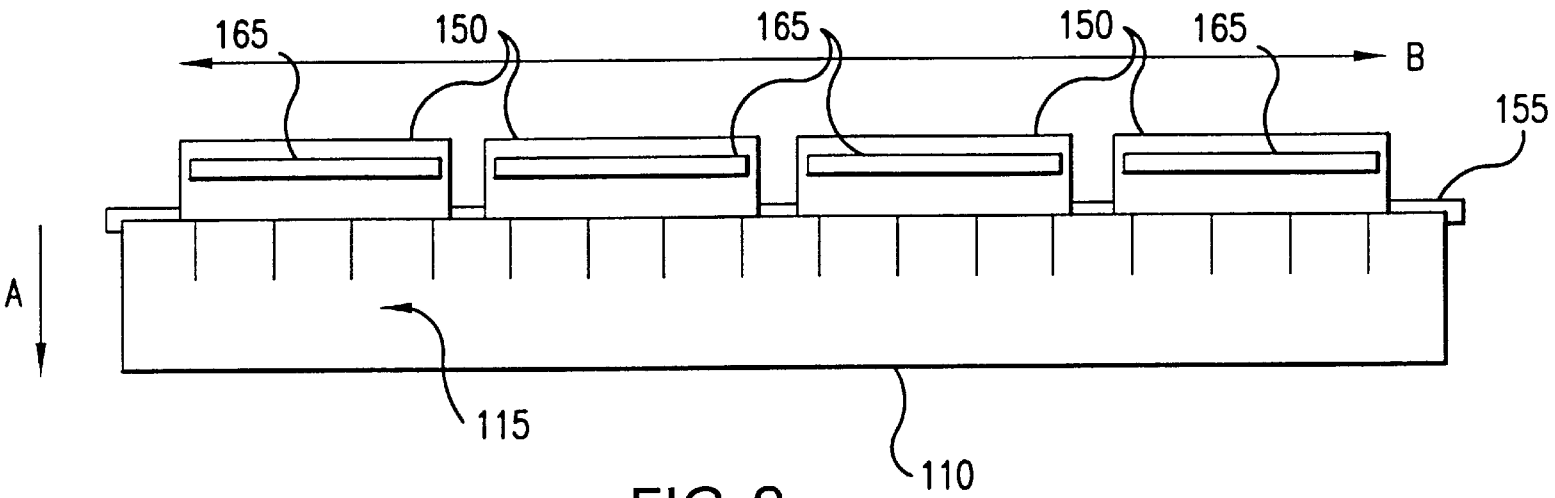
FIG. 2 is an angled plan view of the printing mechanism of FIG. 1.

FIGS. 1 and 2 show the functional elements of a printing mechanism in which the present invention may be implemented. In the preferred embodiment, the deflector plate 170 is not required and is removed from the mechanism. However, other embodiments in accordance with the invention may include a deflector plate to help deflect the paper.

Printing Mechanism

The printing mechanism includes a pen or printhead 120, a platen 110 and a feed device, or mechanism, shown generally at 140. Platen 110 is positioned generally adjacent printhead 120 such that a print zone is defined therebetween. Typically, printhead 120 includes one or more nozzles 125 which together comprise a printing array. Printhead 120 may be referred to as a pen or an ink-jet printhead. In operation, nozzles 125 drop or eject ink droplets onto an upper surface of a sheet of print material 130 positioned adjacent the printhead 120. Typically, printhead 120 is horizontally positioned such that nozzles 125 are located on an underside region of the printhead 120. However, the printhead may be vertically arranged such that the nozzles are positioned on a side of the printhead wherein the sheet of print material is similarly positioned adjacent the side of the printhead.

In operation, a drive roller 150 of the feed mechanism picks a sheet from an input tray containing a stack of sheet material, typically paper, and feeds or advances the sheet into the print zone beneath the printhead 120. Specifically, a sheet of print material 130 is picked from an input tray and held against the driver roller 150 by one or more pinch rollers such that the under surface of sheet 130 contacts the outer surface of the roller as the roller rotates in direction D. The upper-most point or the apex of the drive roller 150 is typically positioned in a plane vertically above the print zone such that the roller 150 conveys the sheet 130 generally downwardly into the print zone and forwardly along feed direction or feed axis A. Print material guide 160 contacts the upper surface of the sheet 130 and co-operates with the drive roller 150 to bias the sheet downwardly into the print zone whilst avoiding contact with the nozzles 125. Typically, an end of the platen 110 is positioned generally adjacent the drive roller 150 to prevent the sheet 130 from continuing around the drive roller 150.

The platen 110 includes a flat expanse 115 and is preferably fixed, or stationary, thereby reducing manufacturing costs, and reducing the complexity of the system. Platen 110 is typically positioned adjacent or opposite the printhead 120 and the print zone such that the platen is coextensive with the printhead along feed axis A.

In summary, feed mechanism 140 conveys a sheet through the print zone generally along axis of travel A. Feed mechanism 140 is configured for contacting the sheet to effect downward movement of the sheet 130 relative to the printhead 120.

Modification of the Feed Mechanism

Figure 3:
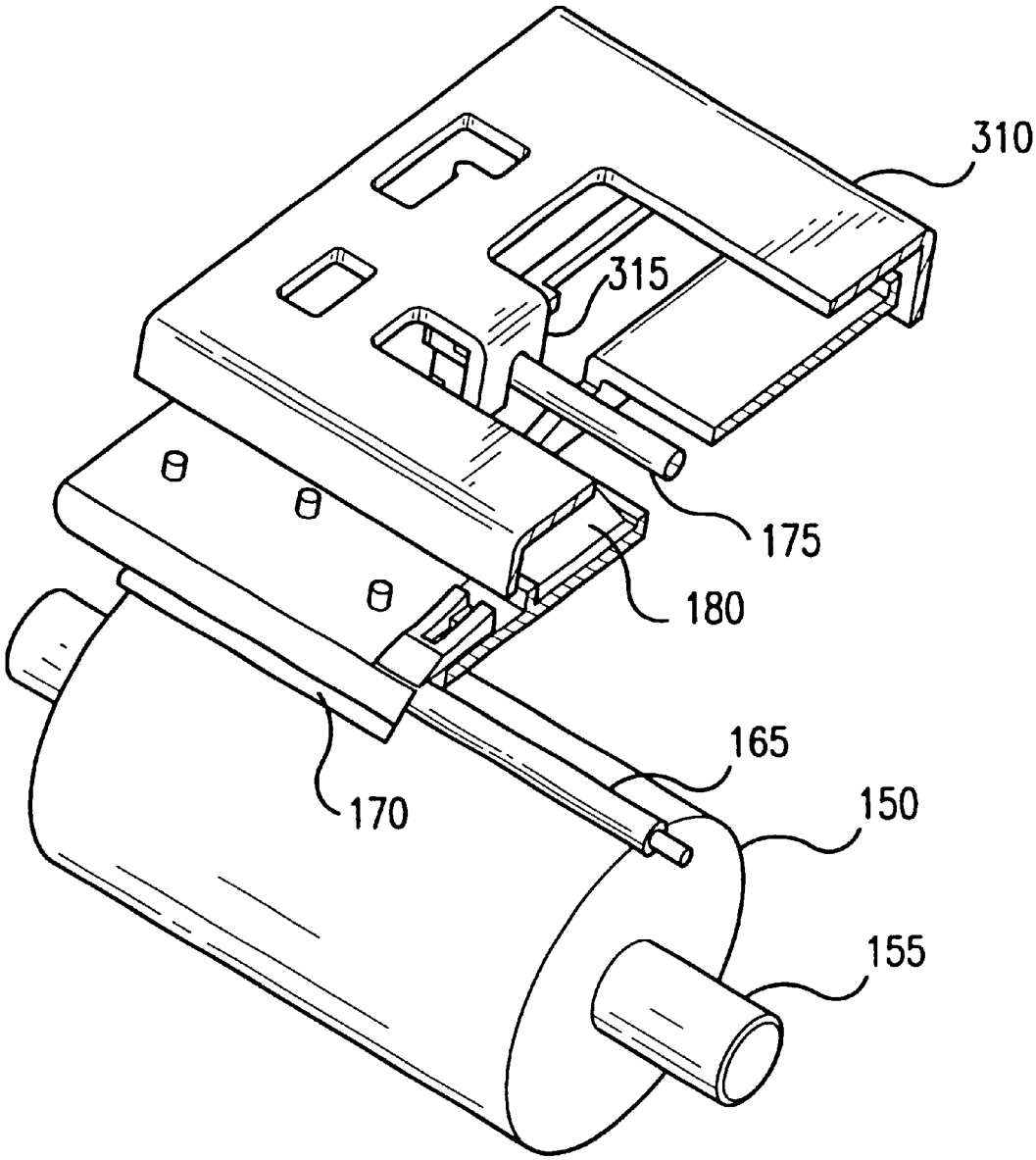
FIG. 3 is a detailed perspective sectional view showing a drive roller, a print media guide, and a support frame of a printer feed mechanism.
Figure 4:
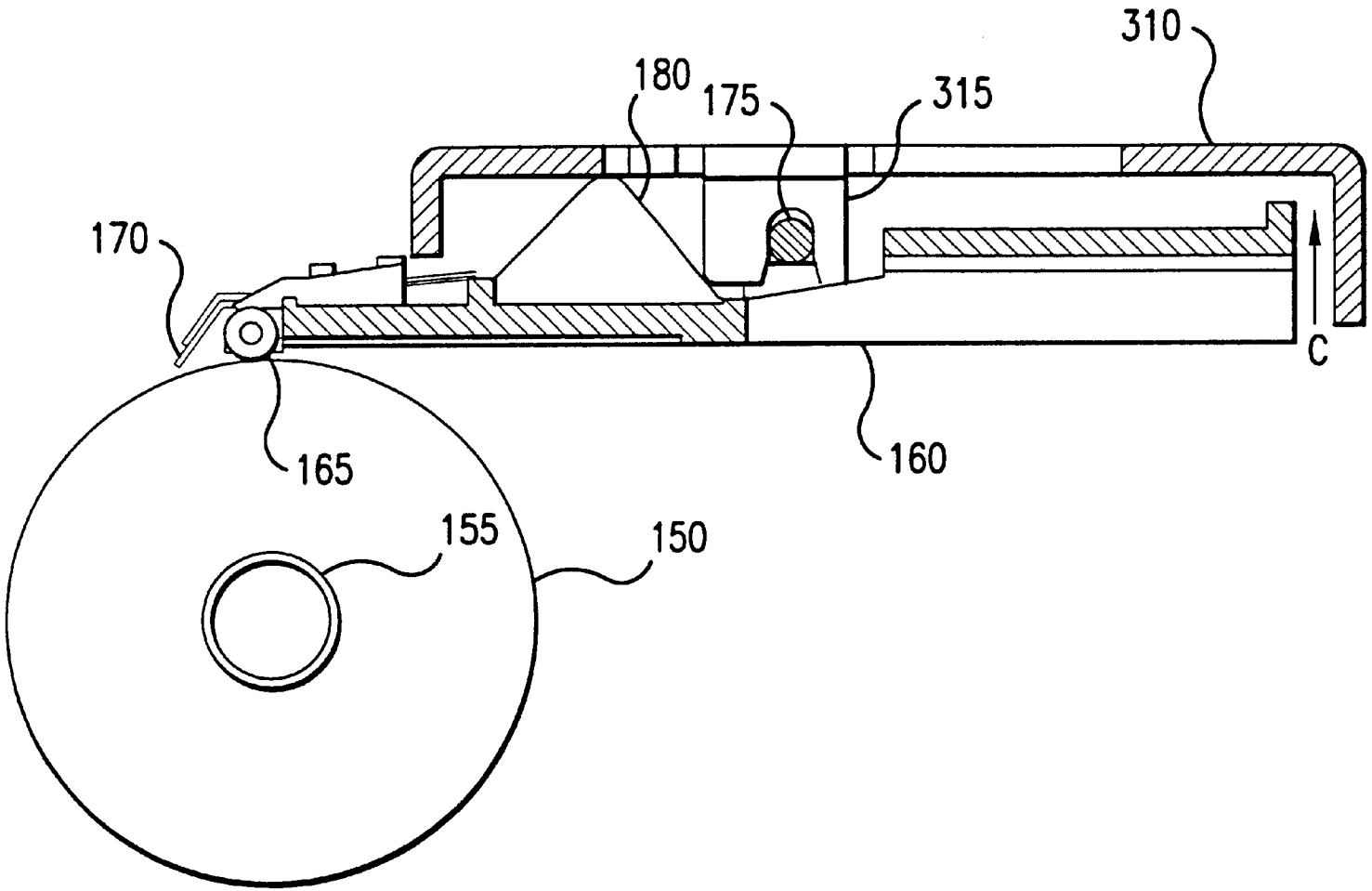
FIG. 4 is a side sectional view of the apparatus of FIG. 3.
Figure 5:
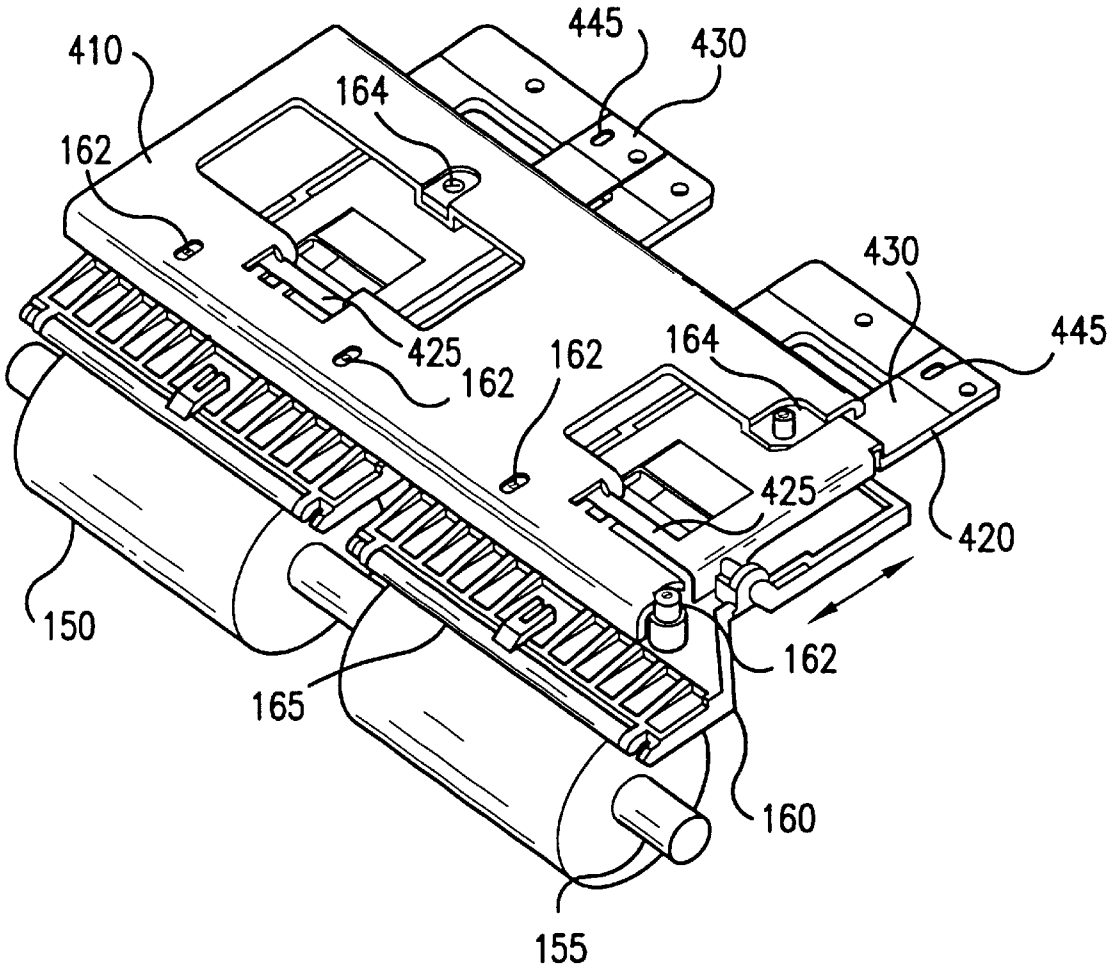
FIG. 5 is a detailed perspective sectional view showing two drive rollers, two print media guides, and a support frame of a printer feed mechanism modified in accordance with the invention.
Figure 6:
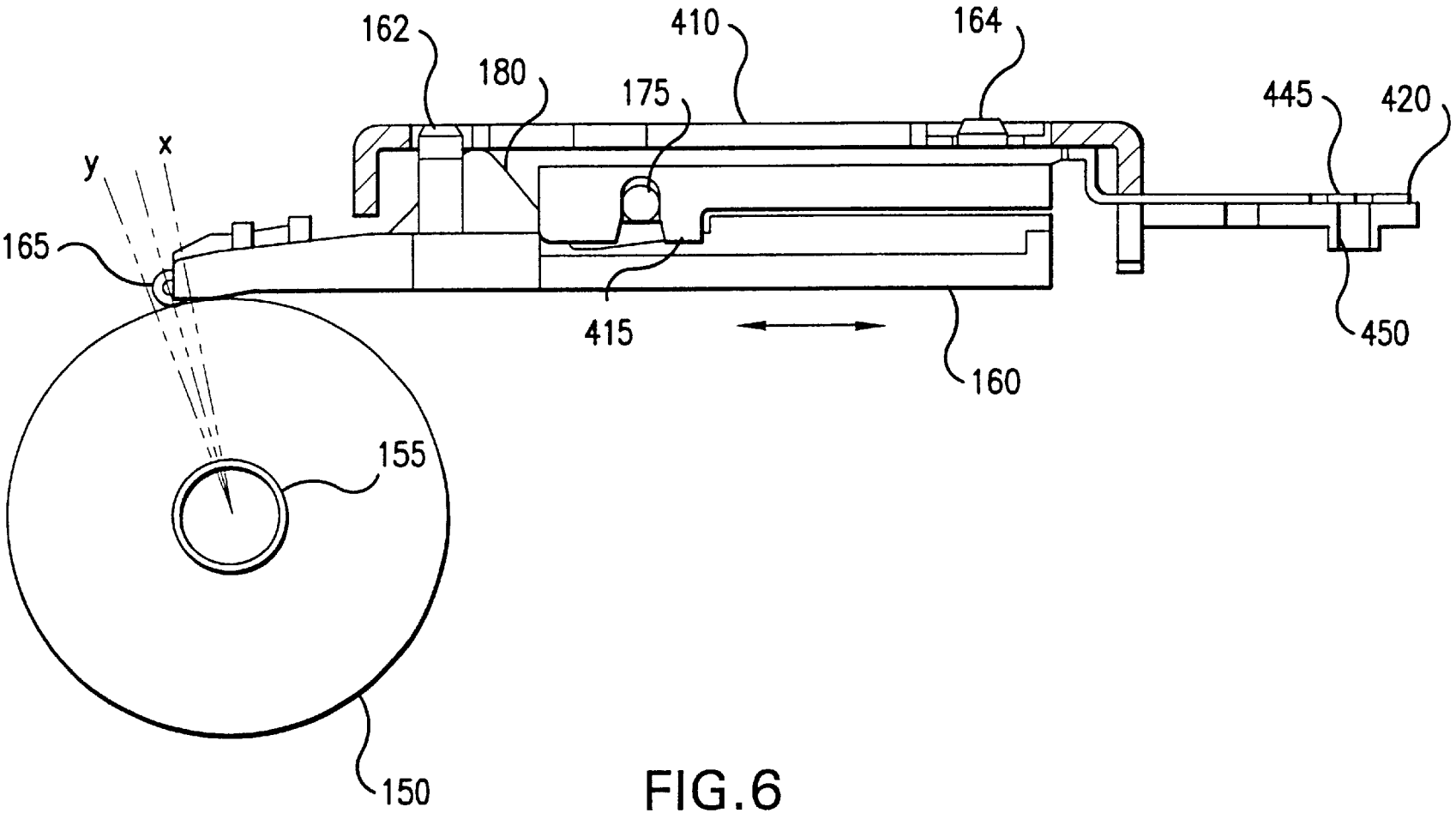
FIG. 6 is a side sectional view of the apparatus of FIG. 5.
Figure 7:
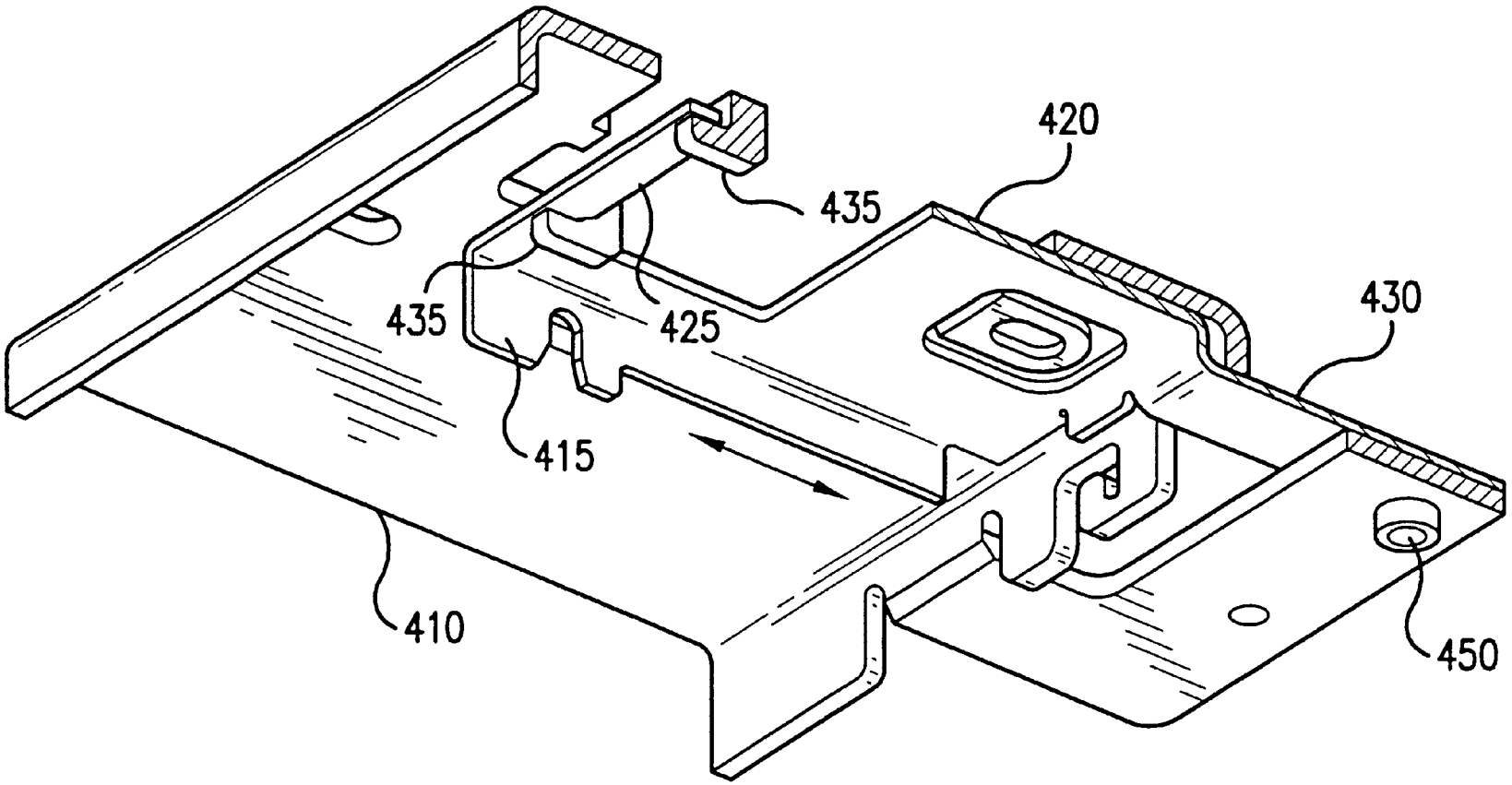
FIG. 7 is a detailed perspective sectional view of the modified support frame of FIGS. 5 and 6 as viewed from below.

In accordance with the invention, the original feed mechanism shown in FIGS. 3 and 4 is modified to enable adjustment of the angular displacement $\alpha$ of the pinch roller (see FIG. 1). This adjustment enables variation of the sheet feed direction to an appropriate or optimum dive angle. Suitably, the dive angle $\alpha$ may be modified between approximately nine degrees and eleven degrees (see positions x and y in FIG. 6). The modified feed mechanism in accordance with the invention is illustrated in FIGS. 5 to 8.

The main modification of the feed mechanism is made to the support frame. The modified support frame is shown generally in FIGS. 5 and 6, and in detail in FIGS. 7 and 8. The modified support frame comprises a main support body 410 and four adjustable coupling portions 420, one for each print medium guide 160. Each coupling portion 420 consists of a contiguous metal frame with a front bar portion 425 and a rear tail portion 430. The front bar portion is supported between the under surface of the main support body 410 and a pair of fingers 435 extending below the under surface. The rear tail portion 430 sits on the upper surface of the main support body 410 and is lockable relative to the main support body using a screw 440 which passes through a slot 445 in the tail portion to a thread 450 in the main support body 410. In the unlocked state, the coupling portion 420 is slidable forwards or backwards relative to the main support body 410. The coupling portion 420 includes a pair of slot guides 415 similar to the slot guides 315 of the support frame 320. As previously, the slot guides 415 receive a rod 175 of the print media guide 160, preventing relative movement between the guide 160 and the coupling portion 420 in the direction of print media motion.

The print media guide 160 is modified to include two front guide pillars 162, and a rear guide pillar 164. With the feed mechanism assembled, the guide pillars 162, 164 locate in slots in the main support body 410. These slots are elongated in the direction of print media motion so that the print media guide 160 and coupling portion 420 can slide forward and backwards together.

Adjustment Procedure

With a sheet 130 in place in the print mechanism, as shown in FIG. 1, the feed mechanism 140 can be adjusted whilst measuring the flatness of the sheet 130 on the platen 110, until optimal flatness is achieved. This adjustment involves unlocking each of the four print media guides 160 from the main support body 410 by releasing the four screws 440. Each print media guide 160 may then be adjusted forwards and backwards, as indicated by the double headed arrows in FIGS. 5 to 8. Once the individual print media guides 160 have been suitably adjusted, the screws 440 can be tightened to lock the guides in the correct position.

What is claimed is:

1. A print feed mechanism for feeding print media in a controlled manner to a printing zone of a printer, the mechanism comprising a drive roller located adjacent the printing zone;

a print media guide having an intake pinch roller positioned against the drive roller for acting in co-operation with the drive roller to feed the print media to the printing zone, and a rod connected to the intake pinch roller; and a main support for supporting the print media guide, having a slot guide for receiving the rod of the print media guide, and an adjustable coupling portion connected to the slot guide for translating the slot guide linearly with respect to the main support such that the intake pinch roller is driven to move circumferentially around the drive roller.

2. A print feed mechanism of claim 1, further comprising a torsion spring coupled between the rod and the main support for biasing the pinch roller towards the drive roller.

* * * * *